US010072839B2

(12) United States Patent
Even et al.

(10) Patent No.: US 10,072,839 B2
(45) Date of Patent: Sep. 11, 2018

(54) GAS FIRED RADIANT EMITTER

(71) Applicant: SOLARONICS S.A., Armentieres (FR)

(72) Inventors: Nicolas Even, Houplines (FR); Didier Alais, Merignies (FR)

(73) Assignee: SOLARONICS S.A., Armentieres (FR)

( * ) Notice: Subject to any disclaimer, the term of this patent is extended or adjusted under 35 U.S.C. 154(b) by 173 days.

(21) Appl. No.: 15/100,143

(22) PCT Filed: Jan. 12, 2015

(86) PCT No.: PCT/EP2015/050405
§ 371 (c)(1),
(2) Date: May 27, 2016

(87) PCT Pub. No.: WO2015/110303
PCT Pub. Date: Jul. 30, 2015

(65) Prior Publication Data

US 2017/0108214 A1 Apr. 20, 2017

(30) Foreign Application Priority Data

Jan. 23, 2014 (EP) ..... 14290005

(51) Int. Cl.
*F23D 3/40* (2006.01)
*F23D 14/14* (2006.01)
*F23D 14/12* (2006.01)

(52) U.S. Cl.
CPC ..... *F23D 14/14* (2013.01); *F23D 14/12* (2013.01); *F23D 2900/11401* (2013.01)

(58) Field of Classification Search
CPC ..... F23D 14/12; F23D 14/14
(Continued)

(56) References Cited

U.S. PATENT DOCUMENTS 2,474,547 A * 6/1949 Patch ..... F23D 14/10 136/219
4,861,261 A 8/1989 Krieger
(Continued)

FOREIGN PATENT DOCUMENTS

DE 4329194 A1 3/1995
EP 0489720 A2 10/1992
(Continued)

OTHER PUBLICATIONS

International Search Report (ISR) dated Mar. 25 2015, for PCT/EP2015/050405.
(Continued)

*Primary Examiner* — Vivek Shirsat
(74) *Attorney, Agent, or Firm* — Bacon & Thomas, PLLC

(57) ABSTRACT

Gas fired radiant emitter having a premixing chamber for preparing a premix of gas and air; a perforated ceramic plate acting as burner deck; and a pilot burner having a premix gas supply flow tube and two electrodes. The premix gas supply flow tube of the pilot burner extends from the side of the perforated ceramic plate where the premixing chamber is located, into a through hole in the perforated ceramic plate. The premix gas supply flow tube has a gas exit in the through hole in the perforated ceramic plate or at the combustion side of the perforated ceramic plate. The gas fired radiant emitter has features so that in an area of the perforated ceramic plate around where the premix gas supply flow tube extends into a through hole in the perforated ceramic plate, no premix gas flows through the perforated ceramic plate.

15 Claims, 3 Drawing Sheets

(58) Field of Classification Search
USPC ..... 431/6, 7, 326, 327, 329, 196, 263
See application file for complete search history.

(56) References Cited

U.S. PATENT DOCUMENTS 5,046,944 A * 9/1991 Smith ..... B31F 1/285
431/326
5,865,616 A * 2/1999 George ..... F23D 14/02
239/553.3

FOREIGN PATENT DOCUMENTS

| | | | |
|---|---|---|---|
| EP | 0598214 | A1 | 5/1994 |
| EP | 0681143 | A2 | 11/1995 |
| WO | 8704773 | | 8/1987 |
| WO | 2010/003904 | A1 | 1/2010 |
| WO | 2010/018037 | A1 | 2/2010 |

OTHER PUBLICATIONS

European Third Party Observation in related European Application No. 15700221.3-1009/3097355.
Vortragsreihe Trocknung Von Papier—APV-Jahrestreffen 1973, Wochenblatt fur Papierfabrikation, Issues 1 to 4, Buntter-Staib Verlag, Biberach.

* cited by examiner

GAS FIRED RADIANT EMITTER

TECHNICAL

The invention relates to gas fired radiant emitters comprising a perforated ceramic burner plate and a pilot burner. The pilot burner can be an ignition pilot burner for igniting the gas fired radiant emitter, or a detection pilot burner acting as flame detection on the gas fired radiant emitter.

BACKGROUND

Gas fired radiant emitters comprising a perforated ceramic burner plate as combustion surface (burner deck) are well known. Such emitters are e.g. used in continuous ovens, e.g. for treating (e.g. drying or curing) continuous webs or sheets, e.g. coatings on paper. The gas fired radiant emitters can be provided with radiant screens in order to increase efficiency. WO2010/018037A1 and WO2010/03904 show examples of such radiant emitters.

The emitters need to be ignited at start-up of the installation. A known way to ignite the emitters is by using a pilot burner appropriately positioned near the burner deck of one or more emitters. A gas premix flows through and exits a tube of the pilot burner. A spark is generated between two electrodes of the pilot burner, thereby igniting the gas premix supplied through the tube of the pilot burner. The flame of the pilot burner subsequently ignites the gas flowing through the perforated ceramic burner deck.

During use of the installation, flame detection is required on the combustion surface of the emitters. If no combustion is detected at the emitters, the supply of combustible gas to the emitters has to be stopped as soon as possible in order to prevent safety incidents. A flame detection pilot burner is frequently used to this end. The flame detection pilot burner is positioned near the combustion surface of the emitters. It comprises a tube through which a gas premix flows. At the exit of the tube, the gas premix is ignited by presence of combustion on the burner deck of the gas fired radiant emitter. The flame detection pilot burner comprises two electrodes, through which ionization current flows when the gas premix flowing through the tube is ignited. Detection of the ionization current indicates that combustion takes place on the burner deck of the emitter. When no combustion takes place on the burner deck, there will no longer be combustion of the premix gas flowing through the tube. When ionization current is no longer measured, absence of combustion on the burner deck is detected and gas supply to the burner deck can be stopped via specific control means.

DE4329194A1 describes a premixing burner with a flame outlet surface of perforated ceramic being ignited by a likewise premixing pilot burner integrated into the radiant main burner. The pilot burner itself is ignited, in a known manner, piezoelectrically, with battery ignition or the like. The radiant main burner and pilot burner utilise the same perforated ceramic plate as flame outlet surface and form a constructional and functional unit. In a burner described as an exemplary embodiment, the distribution space of the pilot burner is integrated into the distribution space of the radiant main burner. The mixing tube of the pilot burner is screwed into the distribution space of the pilot burner through the wall of the distribution space of the radiant main burner. The sealing between the distribution space of the pilot burner and flame outlet surface is provided by means of silicone adhesive, thereby at the same time guaranteeing a gastight separation of radiant main burner and pilot burner.

SUMMARY OF THE INVENTION

The primary objective of the invention is to provide a gas fired radiant emitter comprising a perforated ceramic burner plate and pilot burner, with reliable ignition and/or flame detection means that have a long lifetime; and of which the ignition or detection means can be easily maintained.

According to a first aspect of the invention a gas fired radiant emitter is provided. The gas fired radiant emitter can e.g. be for use in a continuous oven to heat a web-like or sheet-like product which is continuously led through the continuous oven. The radiant emitter comprises:

- a premixing chamber for preparing a premix of gas and air;
- a perforated ceramic plate acting as burner deck, onto which the premix of gas and air can be combusted after it has flown through the perforations of the perforated ceramic plate;
- a pilot burner comprising a premix gas supply flow tube and two electrodes.

In an example, the two electrodes are provided for igniting the premix gas flow flowing through the gas supply tube via the generation of a spark between the two electrodes; the flame that is generated is usable to ignite the gas fired radiant emitter.

In another example the two electrodes are provided for detecting the ionization current in the flame formed by combustion of the premix gas flow flowing through the gas supply tube, wherein the flame is induced by combustion occurring on the burner deck of gas premix flowing through the perforations of the perforated ceramic plate.

The premix gas supply flow tube of the pilot burner extends from the side of the perforated ceramic plate where the premixing chamber is located, into a through hole in the perforated ceramic plate. The premix gas supply flow tube has a gas exit in the through hole in the perforated ceramic plate or at the combustion side of the perforated ceramic plate. Means are provided so that when the emitter is in use, in an area of the perforated ceramic plate around where the premix gas supply flow tube extends into a through hole in the perforated ceramic plate; no premix gas flows through the ceramic plate.

The invention provides gas fired radiant emitters with reliable ignition or flame detection means. The gas fired radiant emitter can be installed in existing ovens where space constraints exist. The gas fired radiant emitter has a long lifetime as separate thermal dilatation of the pilot burner and the gas fired radiant emitter is possible. The gas fired radiant emitter can be installed in existing ovens, as replacement gas fired radiant emitters. It is a benefit that a high density radiant emitter can be made comprising an integrated pilot burner for emitter ignition or for emitter flame detection. A further advantages is the independence of the pilot burner from ambient conditions e.g. mass-transfer system, water, air flows . . . because the pilot burner is protected from the environment by the gas fired emitter itself, e.g. by the frame and/or by the radiant screen of the gas fired radiant emitter. It is a benefit of at least some of the embodiment of the invention that the pilot burner can be replaced in the gas fired radiant emitter independently and in an easy and fast way.

Preferably, the through hole in the perforated ceramic plate has a bigger diameter than the perforations in the perforated ceramic plate.

In a preferred embodiment, the two electrodes are arranged such that in use a flame of the pilot burner is present at the gas exit of the premix gas supply flow tube.

Preferably, the means so that when the emitter is in use, in an area of the perforated ceramic plate around where the premix gas supply flow tube extends into a through hole in the perforated ceramic plate; no premix gas flows through the ceramic plate comprises a seal, e.g. on the perforated ceramic plate, for sealing off the area of the perforated ceramic plate from the premixing chamber. The seal can comprise one or multiple seals on top of each other.

The means so that when the emitter is in use, in an area of the perforated ceramic plate around where the premix gas supply flow tube extends into a through hole in the perforated ceramic plate; no premix gas flows through the ceramic plate, can comprise a partition wall in the housing of the radiant emitter 100. The partition wall can be combined with a seal between the partition wall and the perforated ceramic plate.

Preferably, the radiant emitter has a radiation density of more than 100 $kW/m^2$, more preferably of more than 200 $kW/m^2$, more preferably of more than 300 $kW/m^2$, and even more preferably of more than 400 $kW/m^2$.

In an embodiment of the invention, the area of the perforated ceramic plate around where the premix gas supply flow tube extends into a through hole in the perforated ceramic plate where no premix gas flows through the perforated ceramic plate, comprises at least a number of perforations of the perforated ceramic plate. More preferably the area comprises a number of perforations of the perforated ceramic plate substantially around the full circumference of the through hole in the perforated ceramic plate into which the premix gas supply flow tube extends. With perforation is meant that an open connection is present through these perforations in the ceramic plate.

In an alternative embodiment; the area of the perforated ceramic plate around where the premix gas supply flow tube extends into a through hole in the perforated ceramic plate where no premix gas flows through the ceramic plate, does not comprise perforations in the ceramic plate open for gas flow.

A first example of such embodiment is where the ceramic plate has no perforations in that area.

A second example of such embodiment is where the perforations present in the ceramic plate have been clogged, e.g. by means of a ceramic material, in that area.

It is a benefit of such embodiments that no leakage in either direction can occur, e.g. no combustion products can flow back through perforations in the ceramic plate.

Preferably, the area of the perforated ceramic plate around where the premix gas supply flow tube extends into a through hole in the perforated ceramic plate where no premix gas flows through the ceramic plate, comprises at least 5% of the surface area of the burner deck of the gas fired radiant emitter, more preferably at least 8%, more preferably at least 10%, more preferably at least 12%; and preferably less than 25%, more preferably less than 20%, more preferably less than 15%; e.g. 12.5% or e.g. 7%, of the surface area of the burner deck of the gas fired radiant emitter.

Preferably, the area of the perforated ceramic plate around where the premix gas supply flow tube extends into a through hole in the perforated ceramic plate; where no premix gas flows through the perforated ceramic plate is at least 300 $mm^2$, more preferably at least 750 $mm^2$, even more preferably at least 1000 $m^2$, even more preferably at least 1250 $mm^2$, and preferably less than 2000 $mm^2$.

Preferably, the area of the perforated ceramic plate around where the premix gas supply flow tube extends into a through hole in the perforated ceramic plate where no premix gas flows through the ceramic plate, is located in a corner of the perforated ceramic plate.

Preferably, the gas premix flow tube extends into a through hole of the perforated ceramic plate without making contact with the perforated ceramic plate.

Preferably, the gas premix flow tube extends into a through hole of the perforated ceramic plate without the pilot burner making contact with the perforated ceramic plate.

Preferably, the two electrodes extend from the side of the perforated ceramic plate where the premixing chamber is located; and preferably into the through hole in the perforated ceramic plate. In a preferred embodiment, one of the two electrodes is positioned inside the premix gas supply flow tube and the second electrode is the premix gas supply flow tube or part of the premix gas supply flow tube or connected to the premix gas supply flow tube.

In a preferred embodiment of the invention, the pilot burner can be dismounted and replaced in the gas fired radiant emitter without having to open the premixing chamber.

In a further preferred embodiment, the gas fired radiant emitter comprises a housing enclosing the premixing chamber. The pilot burner is releasable connected to the housing, e.g. by means of bolts (although other means of fixation can be used), such that the pilot burner can be dismounted and replaced without having to open the premixing chamber.

Preferably, the gas fired radiant emitter comprises means for tuning the air to gas ratio of the premix gas supply to flow through the premix gas supply flow tube so that the air to gas ratio of the premix gas supply to flow through the premix gas supply flow tube differs from the air to gas ratio of the premix gas in the premixing chamber. It is a benefit of such embodiment that optimal reliability of the pilot burner (and of the ignition or detection process in which the pilot burner is used) can be achieved, as the premix gas supply to the pilot burner can be tuned independently. When the pilot burner is used to ignite the gas fired radiant emitter, it further contributes to the reliability of the start-up of the radiant emitter. Reliable start up is important in continuous ovens, as e.g. it avoids loss of production.

It is a further benefit that combustion can be set so that emissions of harmful substances can be minimized, e.g. to comply with emission regulations.

A premix gas supply can be tuned so that the power density and appearance of the flames at the exit of the premix gas supply flow tube are substantially similar to the ones of the combustion on the perforated ceramic plate. It avoids local overheating and enables to achieve a same radiation density over the full surface of the radiant emitter.

In a preferred embodiment, the gas fired radiant emitter comprises a cooling flow tube around the premix gas supply flow tube extending from the side of the perforated ceramic plate where the premixing chamber is located, for providing a cooling air flow, e.g. by natural convection or by forced convection, for cooling at least part of the length of the premix gas supply flow tube.

The cooling flow tube can e.g. be provided with means to exit its cooling air at the housing that delimits the premixing chamber of the radiant emitter, preferably at the outside of the housing.

Alternatively, the cooling flow tube can be provided to exit its cooling air flow at the perforated ceramic plate in the area around where the premix gas supply flow tube extends into a through hole of the perforated ceramic plate.

Alternatively, the cooling flow tube can be provided to exit its cooling air flow at the perforated ceramic plate at the gas premixing side of the ceramic plate.

It is also possible to provide the cooling flow tube with means to enter cooling air into the cooling flow tube at the housing that delimits the premixing chamber of the radiant emitter.

In each of the embodiments, appropriate means can be provided for creating a cooling flow by natural convection or by forced convection.

In a preferred embodiment, the gas fired radiant emitter comprises one or more radiation screens positioned on the combustion side at a distance from the perforated ceramic plate. At least one of the one or more radiation screens is interrupted where the premix gas supply flow tube extends into a through hole of the perforated ceramic plate.

As an example, if the radiation screen is provided by a series of rods, the interruption can be achieved by a local larger spacing between rods and/or between rod and the frame of the gas fired radiant emitter.

As an example, if the radiation screen is a woven wire mesh, the interruption can be provided via an opening or hole in the woven wire mesh.

It is a benefit of such embodiments that the gas fired radiant emitter has a longer lifetime, especially pronounced for radiant emitters that have one, two or more woven wire meshes as radiation screen. Where two or more radiant screens are used, they can be positioned at different spacing from the ceramic plate, creating multiple levels of radiation surfaces.

A second aspect of the invention is a radiant oven for treating continuously moving web or sheet material. The radiant oven comprises a number of gas fired radiant emitters positioned over the width of the radiant oven; and wherein at least one of the gas fired radiant emitters is a gas fired radiant emitter as in the first aspect of the invention.

In a preferred embodiment, the number of gas fired emitters positioned over the width direction of the radiant oven comprise at least one gas fired radiant emitter as in the first aspect of the invention wherein the pilot burner is for igniting the gas fired radiant emitter; and at least one gas fired radiant emitter as in the first aspect of the invention wherein the pilot burner is for detecting flames on the burner deck of the gas fired radiant emitter.

Preferably, the gas fired radiant emitter with the pilot burner for ignition is located at an end of the row of emitters over the width direction of the oven.

Preferably, the gas fired radiant emitter with the pilot burner for flame detection is located at an end of the row of emitters over the width direction of the oven.

Preferably, the gas fired radiant emitter with the pilot burner for ignition and the gas fired radiant emitter with the pilot burner for flame detection are located at opposite ends of the row of emitters over the width direction of the oven. Such embodiment has the benefit that an efficient detection of ignition of all radiant emitters in the row can be obtained.

Preferably, the pilot burner can be dismounted without having to dismount from the radiant oven the gas fired radiant emitter which comprises the pilot burner. Such a radiant oven allows replacement of a pilot burner from a radiant emitter in the oven without having to dismount the radiant emitter from the radiant oven. This can e.g. be achieved by using a gas fired radiant emitter comprising a housing enclosing the premixing chamber; wherein the pilot burner is releasable connected to the housing, e.g. by means of bolts, although other fixation means can be used.

A third aspect of the invention is a method of using the gas fired radiant emitter as in the first aspect of the invention in an radiant oven, comprising the step of firing the gas fired radiant emitter at power density of at least 100 $kW/m^2$. Preferably, the radiant emitter is fired at a power density of at least 200 $kW/m^2$, more preferably of at least 300 $kW/m^2$, and even more preferably of at least 400 $kW/m^2$.

DETAILED DESCRIPTION OF THE INVENTION

Figure 1:
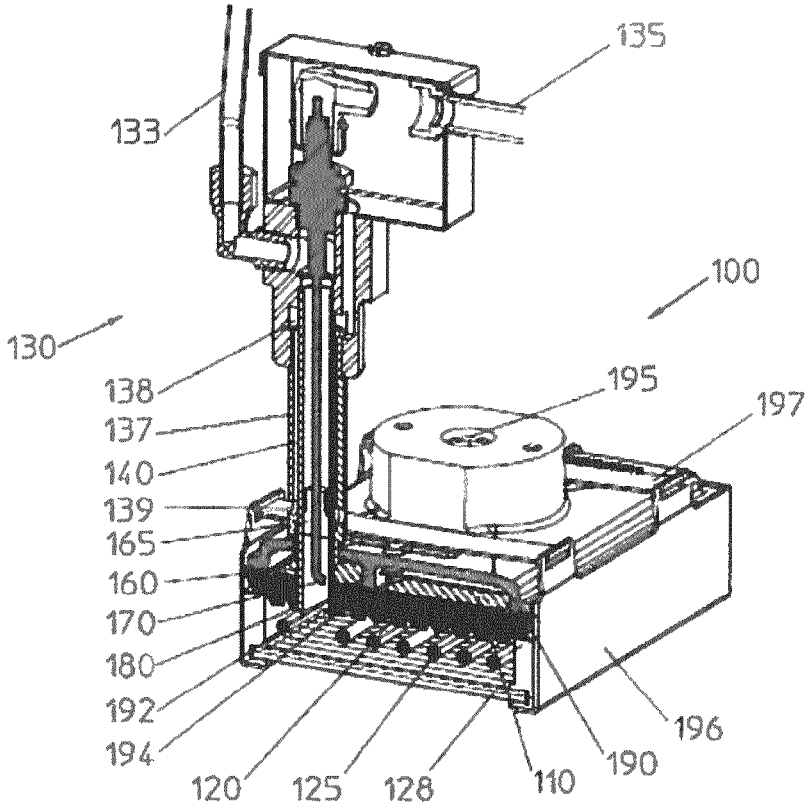
FIG. 1 shows a gas fired radiant emitter according to the first aspect of the invention.

FIG. 1 shows a gas fired radiant emitter 100 according to the invention.

The gas fired radiant emitter 100 comprises

- a premixing chamber 110 for preparing a premix of gas and air;
- a perforated ceramic plate 120 acting as burner deck, onto which the premix of gas and air can be combusted after it has flown through the perforations of the perforated ceramic plate; and
- a pilot burner 130 comprising a premix gas supply flow tube and two electrodes 160, 170. A non-electrically conductive separation part 165 spaces the two electrodes 160 and 170 from each other. The two electrodes 160, 170 extend from the side of the perforated ceramic plate where the premixing chamber 110 is located, and preferably into the through hole in the perforated ceramic plate. The pilot burner 130 comprises a premix gas supply 133 and electrical connections 135 to a control unit (not shown on the figure).

The premix gas supply flow tube 140 of the pilot burner extends from the side of the perforated ceramic plate where the premixing chamber 110 is located, into a through hole 180 in the perforated ceramic plate 120. The premix gas supply flow tube 140 has a gas exit in the through hole 180 in the perforated ceramic plate 120 or at the combustion side of the perforated ceramic plate 120.

Means 192, 194 are provided so that when the emitter is in use, in an area of the perforated ceramic plate 120 around where the premix gas supply flow tube 140 extends into a through hole 180 in the perforated ceramic plate; no premix gas flows through the perforated ceramic plate 120.

In the example of FIG. 1, the means comprise a partition wall 192 in the cast iron housing 190 of the radiant emitter 100, in combination with a seal 194 between the partition wall 192 and the perforated ceramic plate 120.

The housing comprises an inlet 195 to supply premix gas to the premixing chamber 110.

The radiant emitter 100 further comprises side flanges 196 and connection means 197 to connect the side flanges 196 to the housing 190.

The pilot burner 130 is releasable connected to the housing 190, such that the pilot burner 130 can be dismounted and replaced without having to open the premixing chamber 110.

Figure 2:
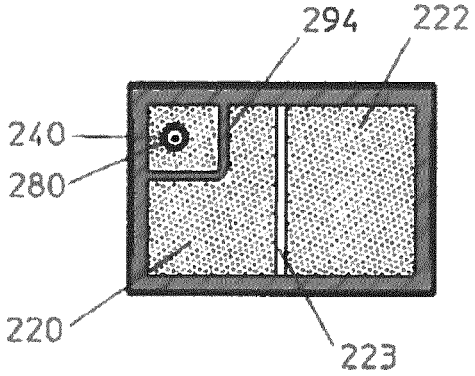
FIG. 2 shows a view perpendicular to the burner deck of an exemplary gas fired radiant emitter according to the invention.

FIG. 2 shows a view at the side where the premixing chamber is located perpendicularly to the burner deck of an exemplary gas fired radiant emitter according to the invention. The gas premix flow tube 240 extends into a through hole 280 of the perforated ceramic plate 220 without the pilot burner and the gas premix flow tube 240 making contact with the perforated ceramic plate 220. Sealing means 294 are provided so that when the emitter is in use, in an area of the perforated ceramic plate 220 around where the premix gas supply flow tube 240 extends into a through hole 280 in the perforated ceramic plate; no premix gas flows through the perforated ceramic plate 220. In the example, the gas fired radiant emitter comprises a second perforated ceramic plate 222, positioned sidewise to the perforated ceramic plate 220. Between the two perforated ceramic plates 220, 222, a seal 223 is provided. In the example, each of the perforated ceramic plates 220, 222 have a surface area of 11628 $mm^2$. The area of the perforated ceramic plate 220 around where the premix gas supply flow tube 240 extends into a through hole 280 in the perforated ceramic plate; and where no premix gas flows through the ceramic plate 220 is 1598 $mm^2$.

In alternative embodiments, no perforations are present in the ceramics plate 220 in the area within the sealing means 294 around where the premix gas supply flow tube 240 extends into a through hole 280 in the ceramic plate 220.

In yet an alternative embodiment, the perforations present in the ceramics plate 220 in the area within the sealing means 294 around where the premix gas supply flow tube 240 extends into a through hole 280 in the ceramic plate 220 are clogged, e.g. by means of a ceramic material, thereby making the perforations impervious to gasses.

The gas fired radiant emitter 100 shown in FIG. 1 comprises in the pilot burner 130 a cooling flow tube 137 around the premix gas supply flow tube 140, extending from the side of the perforated ceramic plate where the premixing chamber 110 is located. The cooling flow tube 137 is provided with an inlet chamber 138 to supply compressed air and with one or more holes 139 to exit the cooling air at the housing 190 that delimits the premixing chamber 110 of the radiant emitter 100.

Alternatively, air can be sucked via holes 139, through the cooling flow tube 137 and exiting the cooling flow tube 137 at the level of chamber 138 via holes not shown in FIG. 1.

The gas fired radiant emitter 100 of FIG. 1 comprises two radiation screens 125, 128 positioned on the combustion side at a distance from the perforated ceramic plate 120. The radiation screen 125, which is located closest to the perforated ceramic plate 120, is interrupted where the premix gas supply flow tube 140 extends into a through hole 180 of the perforated ceramic plate 120.

As an example, the radiation screen 125 can be formed by a series of bars out of a temperature resistant material (e.g. appropriate ceramic material), wherein one or more bars are missing thereby creating the interruption where the premix gas supply flow tube extends into a through hole of the perforated ceramic plate.

Figure 3:
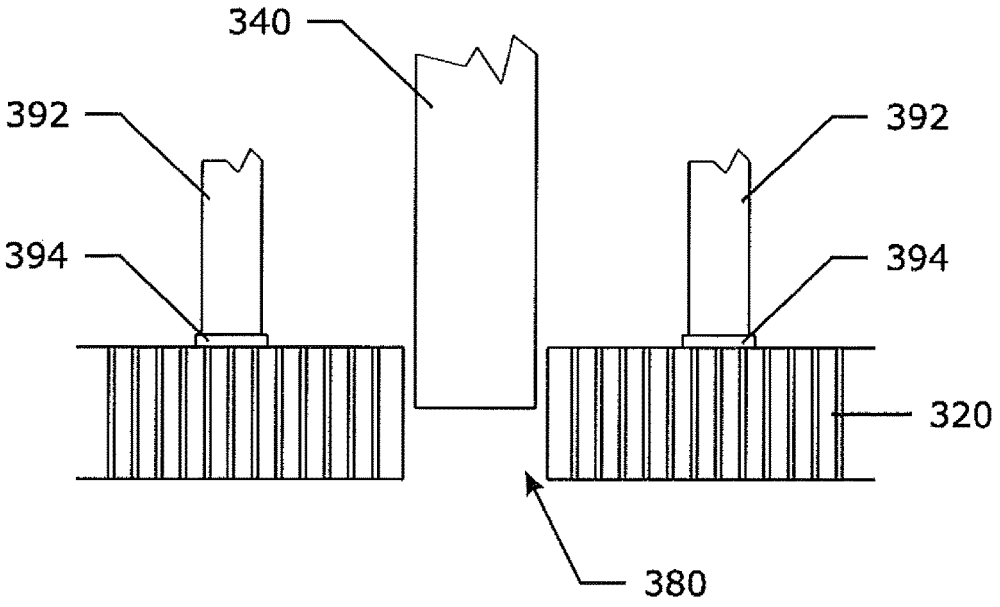
FIGS. 3 and 4 show embodiments of the invention.

FIG. 3 schematically shows a gas fired radiant emitter according to the first aspect of the invention wherein the premix gas supply flow tube 340 has a gas exit in the through hole 380 in the perforated ceramic plate 320. A partition wall 392, in combination with a seal 394 between the partition wall 392 and the perforated ceramic plate 320 is provided as means so that when the emitter is in use, in an area of the perforated ceramic plate 320 around where the premix gas supply flow tube 340 extends into a through hole 380 in the perforated ceramic plate; no premix gas flows through the perforated ceramic plate 320.

Figure 4:
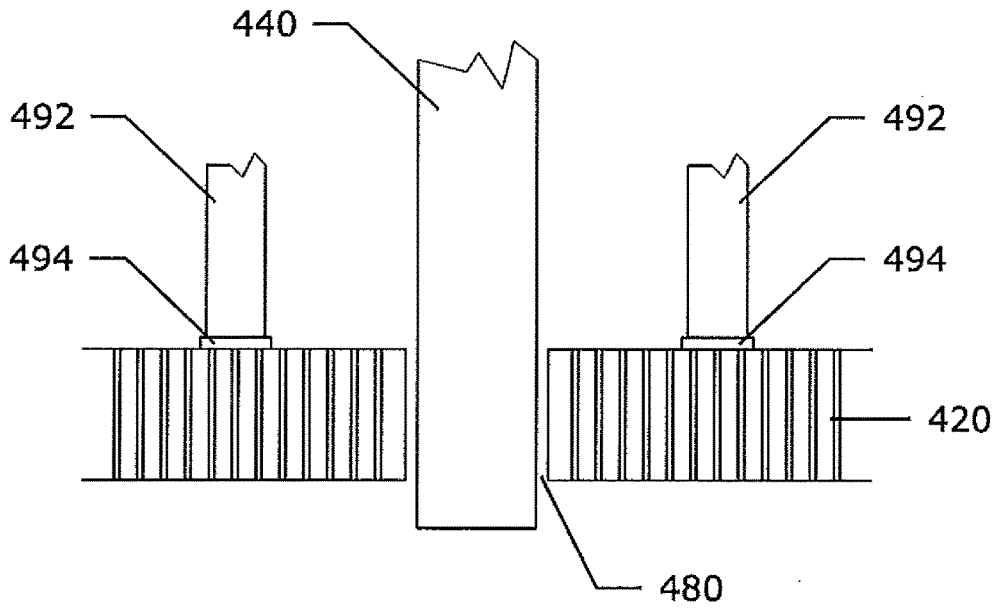

FIG. 4 schematically shows a gas fired radiant emitter according to the first aspect of the invention wherein the premix gas supply flow tube 440 has a gas exit at the combustion side of the perforated ceramic plate 420. A partition wall 492, in combination with a seal 494 between the partition wall 492 and the perforated ceramic plate 420 is provided as means so that when the emitter is in use, in an area of the perforated ceramic plate 420 around where the premix gas supply flow tube 440 extends into a through hole 480 in the perforated ceramic plate; no premix gas flows through the perforated ceramic plate 420.

Figure 5:
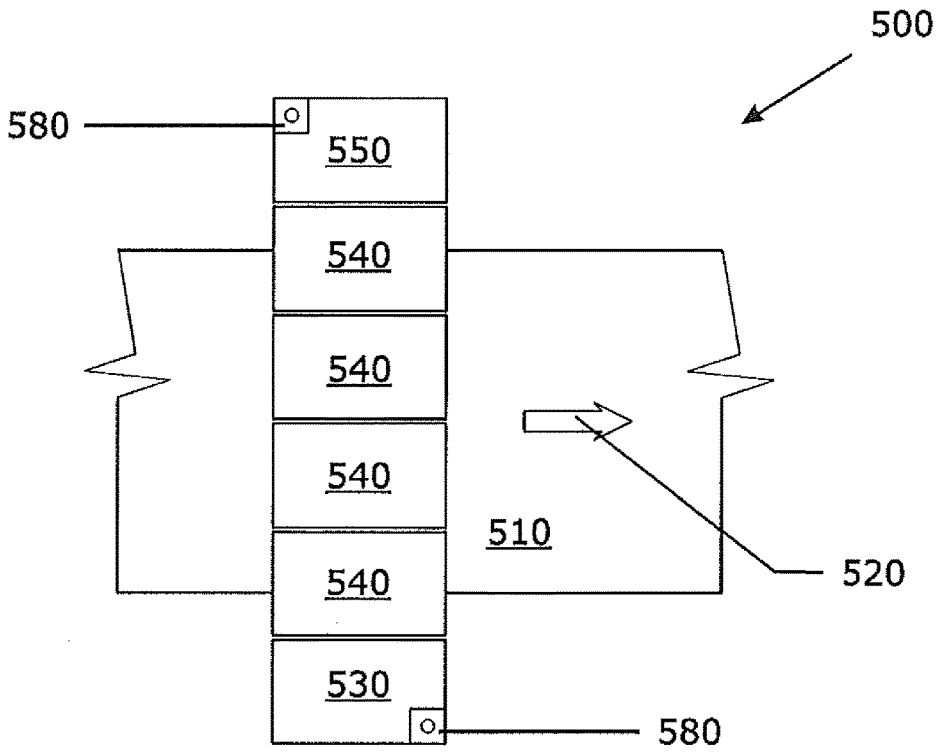
FIG. 5 schematically shows a radiant oven according to the second aspect of the invention.

FIG. 5 schematically shows a radiant oven 500 for treating continuously moving web of sheet material according to the second aspect of the invention. A web-like (e.g. paper) or sheet-like (e.g. a steel strip) material 510 is lead through the continuous oven 500 in the direction of arrow 520. The radiant oven 500 comprises a number of gas fired radiant emitters 530, 540, 550 positioned over the width direction of the oven 500. At one end of the row of radiant emitters, a gas fired radiant emitter 530 is located according to the first aspect of the invention wherein the pilot burner 580 is arranged for igniting the gas fired radiant emitter. At the other end of the row of radiant emitters, a gas fired radiant emitter 550 is located according to the first aspect of the invention wherein the pilot burner 580 is arranged for detecting flames on the burner deck of the gas fired radiant emitter.

Figure 6:
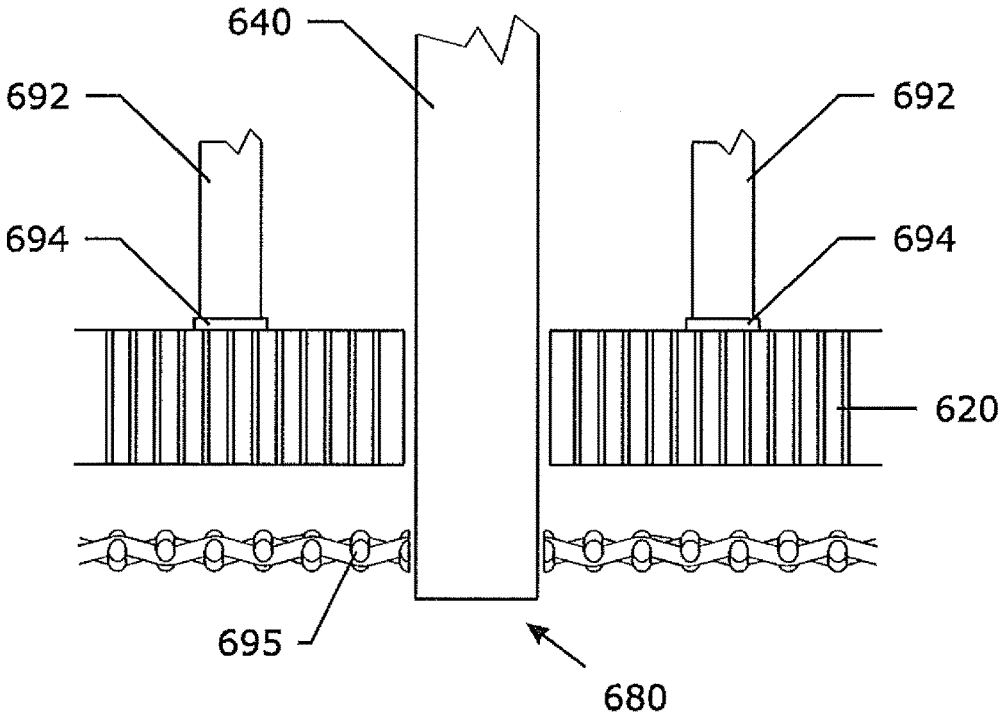
FIG. 6 shows a gas fired radiant emitter according to the first aspect of the invention.

FIG. 6 schematically shows a gas fired radiant emitter according to the first aspect of the invention. The emitter comprises a radiant screen 695, e.g. a woven wire mesh. The premix gas supply flow tube 640 has a gas exit at the combustion side of the perforated ceramic plate 620, where the premix gas supply flow tube 640 extends through an opening in the radiant screen 695. A partition wall 692, in combination with a seal 694 between the partition wall 692 and the perforated ceramic plate 620 is provided as means so that when the emitter is in use, in an area of the perforated ceramic plate 620 around where the premix gas supply flow tube 640 extends into a through hole 680 in the perforated ceramic plate; no premix gas flows through the perforated ceramic plate 620.

The invention claimed is:

1. A gas fired radiant emitter comprising:

a premixing chamber for preparing a premix of gas and air;

a perforated ceramic plate acting as burner deck, onto which the premix of gas and air can be combusted after it has flown through the perforations of the perforated ceramic plate;

a pilot burner comprising a premix gas supply flow tube and two electrodes; wherein the premix gas supply flow tube of the pilot burner extends from the side of the perforated ceramic plate where the premixing chamber is located, into a through hole in the perforated ceramic plate;

and wherein the premix gas supply flow tube has a gas exit in the through hole in the perforated ceramic plate or at the combustion side of the perforated ceramic plate; and wherein means are provided so that when the emitter is in use, in an area of the perforated ceramic plate around where the premix gas supply flow tube extends into a through hole in the perforated ceramic plate, no premix gas flows through said area of the perforated ceramic plate, wherein the through hole comprises an annular opening around the pilot burner, and wherein the annular opening creates a fluid flow connection between both surfaces of the perforated ceramic plate; and wherein no combustible gas flows through the annular opening.

2. The gas fired radiant emitter as in claim 1, wherein the two electrodes are arranged such that in use a flame of the pilot burner is present at the gas exit of the premix gas supply flow tube.

3. The gas fired radiant emitter as in claim 1, wherein the area of the perforated ceramic plate around where the premix gas supply flow tube extends into a through hole in the perforated ceramic plate where no premix gas flows through the ceramic plate, comprises at least a number of perforations of the perforated ceramic plate.

4. The gas fired radiant emitter as claim 1, wherein the area of the perforated ceramic plate around where the premix gas supply flow tube extends into a through hole in the perforated ceramic plate where no premix gas flows through the ceramic plate, does not comprise perforations in the ceramic plate open for gas flow.

5. The gas fired radiant emitter as in claim 1, wherein said means comprise a seal for sealing off an area of the ceramic plate from the premixing chamber.

6. The gas fired radiant emitter as in claim 1, wherein the gas premix flow tube extends into a through hole of the perforated ceramic plate without the pilot burner making contact with the perforated ceramic plate.

7. The gas fired radiant emitter as in claim 1, wherein the two electrodes extend from the side of the perforated ceramic plate where the premixing chamber is located, and into the through hole in the perforated ceramic plate.

8. The gas fired radiant emitter as in claim 1, wherein the pilot burner can be dismounted and replaced in the gas fired radiant emitter without having to open the premixing chamber.

9. The gas fired radiant emitter as in claim 1, wherein the gas fired radiant emitter comprises a housing enclosing the premixing chamber;

and wherein the pilot burner is releasably connected to the housing, such that the pilot burner can be dismounted and replaced without having to open the premixing chamber.

10. The gas fired radiant emitter as in claim 1, comprising a cooling flow tube around the premix gas supply flow tube extending from the side of the perforated ceramic plate where the premixing chamber is located, for providing a cooling air flow for cooling at least part of the length of the premix gas supply flow tube.

11. The gas fired radiant emitter of claim 10, wherein the cooling flow tube is provided with means to exit its cooling air at the housing that delimits the premixing chamber of the radiant emitter;

or wherein the cooling flow tube is provided with means to enter cooling air into the cooling flow tube at the housing that delimits the premixing chamber of the radiant emitter.

12. A gas fired radiant emitter comprising:

a premixing chamber for preparing a premix of gas and air;

a perforated ceramic plate acting as burner deck, onto which the premix of gas and air can be combusted after it has flown through the perforations of the perforated ceramic plate;

a pilot burner comprising a premix gas supply flow tube and two electrodes; wherein the premix gas supply flow tube of the pilot burner extends from the side of the perforated ceramic plate where the premixing chamber is located, into a through hole in the perforated ceramic plate;

and wherein the premix gas supply flow tube has a gas exit in the through hole in the perforated ceramic plate or at the combustion side of the perforated ceramic plate; and wherein means are provided so that when the emitter is in use, in an area of the perforated ceramic plate around where the premix gas supply flow tube extends into a through hole in the perforated ceramic plate, no premix gas flows through said area of the perforated ceramic plate;

further comprising one or more radiation screens positioned on the combustion side at a distance from the perforated ceramic plate; and wherein at least one of the one or more radiation screens has an opening where the premix gas supply flow tube extends into a through hole of the perforated ceramic plate.

13. A radiant oven for treating continuously moving web of sheet material, comprising a number of gas fired radiant emitters positioned over the width of the radiant oven; wherein at least one of the gas fired radiant emitters is a gas fired radiant emitter as in claim 1.

14. The radiant oven as in claim 13, wherein the pilot burner is configured to be dismounted without having to dismount from the radiant oven the gas fired radiant emitter which comprises the pilot burner.

15. A method of using the gas fired radiant emitter as in claim 1 in a radiant oven, comprising the steps of firing the gas fired radiant emitter at a power density of at least 100 $kW/m^2$.

* * * * *